US007795177B2

(12) United States Patent
Onishi et al.

(10) Patent No.: US 7,795,177 B2
(45) Date of Patent: Sep. 14, 2010

(54) THERMAL TRANSFER RECEIVING SHEET AND ITS MANUFACTURING METHOD

(75) Inventors: Toshikazu Onishi, Tokyo (JP); Toru Nakai, Tokyo (JP); Kazuyuki Tachibana, Tokyo (JP); Kyoko Uchida, Tokyo (JP); Yoshimasa Tanaka, Tokyo (JP); Yoshihiro Shimizu, Tokyo (JP); Hideaki Shinohara, Tokyo (JP); Masato Kawamura, Tokyo (JP); Chikara Tsukada, Tokyo (JP)

(73) Assignee: Oji Paper Co., Ltd., Tokyo (JP)

( * ) Notice: Subject to any disclaimer, the term of this patent is extended or adjusted under 35 U.S.C. 154(b) by 856 days.

(21) Appl. No.: 11/631,479

(22) PCT Filed: Jul. 7, 2005

(86) PCT No.: PCT/JP2005/012973

§ 371 (c)(1),
(2), (4) Date: Jan. 4, 2007

(87) PCT Pub. No.: WO2006/006639

PCT Pub. Date: Jan. 19, 2006

(65) Prior Publication Data

US 2008/0020196 A1 Jan. 24, 2008

(30) Foreign Application Priority Data

Jul. 8, 2004 (JP) ..... 2004-201552
Jul. 15, 2004 (JP) ..... 2004-208402
Sep. 10, 2004 (JP) ..... 2004-264392

(51) Int. Cl.
*B41M 5/035* (2006.01)
*B41M 5/50* (2006.01)

(52) U.S. Cl. ..... 503/227; 427/152

(58) Field of Classification Search ..... None
See application file for complete search history.

(56) References Cited

U.S. PATENT DOCUMENTS 6,165,938 A 12/2000 Narita et al.
6,372,689 B1 4/2002 Kuga et al.

FOREIGN PATENT DOCUMENTS

| | | |
|---|---|---|
| EP | 0590322 | 4/1994 |
| JP | 4-82790 | 3/1992 |
| JP | 4-270688 | 9/1992 |
| JP | 5-169845 | 7/1993 |
| JP | 6-227159 | 8/1994 |
| JP | 6-234282 | 8/1994 |
| JP | 7-17148 | 1/1995 |
| JP | 7-137461 | 5/1995 |
| JP | 8-25811 | 1/1996 |
| JP | 9-123623 | 5/1997 |
| JP | 9-300830 | 11/1997 |
| JP | 10-129128 | 5/1998 |
| JP | 11-34513 | 2/1999 |
| JP | 11-34516 | 2/1999 |
| JP | 2000-1057 | 1/2000 |
| JP | 2000-238440 | 9/2000 |
| JP | 2000-272259 | 10/2000 |
| JP | 2001-39043 | 2/2001 |
| JP | 2001-138641 | 5/2001 |
| JP | 2001-199172 | 7/2001 |
| JP | 2002-86937 | 3/2002 |
| JP | 2002-166660 | 6/2002 |
| JP | 2002-200851 | 7/2002 |
| JP | 2004-58403 | 2/2004 |
| JP | 2004-122375 | 4/2004 |

OTHER PUBLICATIONS

European Search Report dated Oct. 29, 2008, issued on the corresponding European Application No. 08 16 4977.4.
Office Action dated Sep. 19, 2008, issued on the corresponding Chinese Patent Application No. 200580023014.4 and the partial English translation thereof.
Communication dated Feb. 25, 2008 from the European Patent Office, issued on EP Patent Application 05 760 096.7-1251.
Office Action dated Mar. 16, 2009 for the corresponding Japanese patent application No. 2005-191476 and the English partial translation thereof.

*Primary Examiner*—Bruce H Hess
(74) *Attorney, Agent, or Firm*—Edwards Angell Palmer & Dodge LLP

(57) ABSTRACT

The present invention provides a thermal transfer receiving sheet obtained by sequentially forming a hollow particle-containing intermediate layer and an image receiving layer on one surface of a sheet-like support mainly comprising cellulose pulp, wherein the moisture content of the entire thermal transfer receiving sheet is from 2 to 8 mass % and the moisture permeability of the entire receiving sheet is 400 g/m$^2$·day or less; and a production method thereof. The present invention further provides a thermal transfer receiving sheet obtained by sequentially forming a hollow particle-containing intermediate layer and an image receiving layer on one surface of a sheet-like support mainly comprising cellulose pulp and providing a backside layer on another surface of the support, wherein the backside layer mainly comprises an acryl-based resin having a glass transition point (Tg) of 45° C. or less and contains a resin filler having an average particle diameter of 5 to 22 μm and the Bekk smoothness according to JIS P 8119 on the backside layer surface is 100 seconds or less.

17 Claims, No Drawings

THERMAL TRANSFER RECEIVING SHEET AND ITS MANUFACTURING METHOD

TECHNICAL FIELD

The present invention relates to a thermal transfer receiving sheet (hereinafter sometimes simply referred to as a "receiving sheet") for use in a printer which forms an image by thermally transferring a dye of a thermal transfer dye sheet to an image receiving layer. More specifically, the present invention relates to a receiving sheet suitable for a thermal printer, particularly a dye thermal transfer printer, ensuring that fusion-bonding between an image receiving layer (hereinafter sometimes simply referred to as a "receiving layer") containing a dye-dyeable resin and a dye layer containing a dye of a thermal transfer dye sheet (hereinafter sometimes simply referred to as an "ink ribbon") less occurs at printing and the image uniformity is excellent. The present invention also relates to a receiving sheet assured of no curling in various environments, less warpage of blank paper and good back printing suitability of the back surface.

BACKGROUND ART

Among thermal printers, a dye thermal transfer printer capable of printing a clear full color image is recently attracting particular attention. In a dye thermal transfer printer, a dye layer containing a dye of an ink ribbon is superposed on an image receiving layer of a receiving sheet, and the dye of the dye layer in a required portion is transferred at a predetermined concentration onto the receiving layer by the effect of heat supplied from a thermal head or the like, whereby an image is formed. The ink ribbon comprises dye layers for three colors of yellow, magenta and cyan or dye layers for four colors additionally including black. A full color image is obtained by repeatedly transferring respective color dyes of the ink ribbon in sequence to a receiving sheet.

With the progress of a digital image processing technique using a computer, the image quality or the like of a recorded image is remarkably enhanced and the market for thermal transfer system is expanding, but there is a demand for image quality and glossy texture comparable to those of a silver salt photograph. Also, as the technique of controlling the temperature of a thermal head is improved, the demand for a high-speed high-sensitivity printing system is increasing. To cope with such requirements, how efficiently the heat value of a heating device such as thermal head is utilized for the image formation becomes an important problem to be solved.

A receiving sheet generally comprises a support and a receiving layer formed on the surface thereof. When a normal film is used as a substrate for the support, despite excellent smoothness, the heat from a thermal head may escape to the substrate to give rise to insufficient recording sensitivity, or since a film is lacking in the satisfactory cushioning property, the ink ribbon and the receiving sheet may fail in closely contacting with each other and this may cause density unevenness or the like.

In order to solve these problems, there have been proposed supports, for example, a support obtained by laminating a foamed film on a core material layer such as paper sheets (see, for example, Japanese Unexamined Patent Publication (Kokai) No. 61-197282 (page 1)), and a support obtained by laminating a biaxially stretched film (synthetic paper) mainly comprising a thermoplastic resin such as polyolefin resin and containing a void structure, on a core material layer such as paper sheets (see, for example, Kokai No. 62-198497 (page 1)). The receiving sheet using such a support is excellent in the heat insulating property and smoothness but, disadvantageously, the receiving sheet is dimpled due to heat and pressure at the transportation or printing in a printer and the appearance is impaired.

Furthermore, the foamed film is expensive or a thick foamed film needs to be used in order to control the thickness of the entire receiving sheet to a desired thickness, which incurs a problem that the profitability is low or a problem that the texture of the obtained receiving sheet differs from that of a silver salt photographic printing paper.

When a paper sheet is used as the support substrate of the receiving sheet, the heat from a thermal head disadvantageously escapes to the substrate to render the recording sensitivity insufficient. The cushioning property of paper sheets is somewhat higher than that of a film, but the close contact between the ink ribbon and the receiving layer becomes non-uniform due to uneven fiber density of paper and the print comes to have irregular shading.

In order to solve these problems, a receiving sheet where an intermediate layer containing hollow particles is provided between a paper support and a receiving layer has been disclosed (see, for example, Kokai Nos. 63-87286 (pages 1 and 2) and 1-27996 (pages 1 to 3)). In this receiving sheet, the hollow particle-containing layer provides an effect of enhancing the heat insulating property or cushioning property to thereby improve the sensitivity or image quality, but there arises a phenomenon that releasability between the receiving layer and the ink ribbon at the printing is poor as compared with the case of using a support or the like obtained by laminating a foamed film on a core material layer such as paper sheets. In other words, fusion-bonding is liable to occur.

This is considered to arise because of the following reason. A polyisocyanate is generally blended in the receiving layer for the purpose of three-dimensionally crosslinking a release agent or a thermoplastic resin so as to prevent fusion-bonding with the dye layer of an ink ribbon (see, for example, Kokai No. 10-129128 (pages 2 to 4)), but since the moisture contained in paper sheets selectively reacts with the polyisocyanate, desired three-dimensional crosslinking cannot be achieved for the resin of the receiving layer and this leads to a failure in obtaining a sufficiently high effect of preventing fusion-bonding. In this respect, an improvement is demanded.

Also, the moisture content of the receiving sheet after allowing the receiving sheet to stand for one day in a fixed temperature/humidity atmosphere is specified and this is considered to have reached almost equilibrium, but the moisture content during or immediately after the production is not known. Furthermore, for example, formation of a waterproof layer between a paper substrate and a foamed layer, or formation of an anticurling layer on the back surface side of a substrate has been disclosed (see, for example, Kokai No. 8-25811 (pages 2 to 4)). However, the fusion-bonding between the receiving layer and the ink ribbon at printing as referred to in the present invention is mainly attributed to the performance of the receiving layer, and the performance of the receiving layer is considered to be greatly affected by the receiving layer components such as crosslinking agent or by the construction of hollow particle-containing intermediate layer, barrier layer or the like in the vicinity of the receiving layer.

As for the adhesive resin used in the intermediate layer, it has been proposed, for example, to use an organic solvent-resistant resin (preferably polyvinyl alcohol, casein, starch or the like) (see, for example, Kokai No. 1-27996 (pages 1 to 3)) or a resin having a minimum film-forming temperature of 25°

C. or more (see, for example, Kokai No. 7-17149 (page 2)). However, when such a resin is used alone, there arises a problem that uniform formation of the intermediate layer or formation of a flexible layer becomes difficult. In this respect, an improvement is demanded.

Also, a void distribution in the surface coating layer of a transfer sheet as measured by a mercury press-fitting porosimeter (see, for example, Kokai No. 7-98510 (page 2)), a dynamic hardness on the surface of a thermal transfer ink-receiving layer (see, for example, Kokai No. 2002-11969 (page 2)), and the like have been disclosed, but such properties are used involved in a fusion-type thermal transfer system or an electrophotographic system and are limited to the characteristics of the receiving layer surface.

A receiving sheet using a paper substrate as the support is relatively inexpensive and can form an image with a sufficiently high density by providing an intermediate layer, but this receiving sheet is disadvantageously liable to absorb environmental moisture and readily brings about warpage, so-called curling, due to fluctuation of humidity. Furthermore, although a coating layer such as intermediate layer and receiving layer is provided on one surface of the receiving sheet, such a coating layer generally has very small moisture absorption as compared with paper and the difference in the degree of moisture absorption from the paper substrate gives rise to generation of curling. More specifically, so-called top curling is generated on the receiving layer surface side in a high-humidity environment because the paper support tends to absorb moisture and expand, whereas so-called back curling is generated on the side opposite the receiving layer in a low-humidity environment because the paper substrate tends to shrink.

For various purposes such as improvement of printing/traveling performance, a backside layer is provided on the back surface (surface opposite the intermediate layer or receiving layer) of the receiving sheet. For example, with respect to the resin for the formation of the backside layer, a method of using a polyvinyl acetal resin and an acryl resin having a glass transition point of 50° C. or more in combination has been disclosed (see, for example, Kokai No. 4-161383 (page 1). However, this backside layer is intended mainly to, for example, improve non-dyeability or prevent electrostatic charge, and the anticurling property is not necessarily satisfied. In order to render the backside layer effective for the curling correction, a resin having good film-forming property needs to be coated to form a highly elastic film.

Also, as high-speed high-sensitivity processing of a thermal transfer recording system proceeds, the heating value supplied at printing from a thermal head to a receiving sheet is increased and at the same time, a back printing failure tends to readily occur. The back printing failure is a problem such that when the front and back of a receiving sheet are mixed up at the loading of receiving sheets into a thermal transfer printer and printing is performed, the ink ribbon and the back surface of a receiving sheet are fusion-bonded and paper jamming is caused. The back surface of a receiving sheet is demanded to possess a fusion-preventing property so as to allow for paper discharging without fusion-bonding of the ink ribbon and the backside layer even at back printing.

It is known to add various fillers for imparting back printing suitability to the backside layer of a receiving layer. By the addition of a filler, the backside layer can be made slippery and the ink ribbon can be prevented from fusion-bonding with the back surface of a receiving sheet due to heat of a thermal head at back printing. As for the filler, organic or inorganic fine powders, fine particles or fine particle emulsions and the like have been proposed.

For example, for the purpose of ensuring printing/traveling performance, antiscratching or the like, a method of using a resin and a filler of the same species as the resin for the backside layer and causing the filler to be not exposed but covered with the resin (see, for example, Kokai No. 8-25814 (page 2)), or a method of incorporating an organic filler having a particle diameter of 0.5 to 30 μm into the backside layer and adjusting the surface roughness to from 0.3 to 3.0 μm (see, for example, Kokai No. 9-123623 (page 2)) have been proposed. However, means for preventing curling in a high humidity environment, which is peculiar to a paper support, is not disclosed.

Also, a method of incorporating spherical particles having an average particle diameter of 2 to 6 μm and an average particle diameter of 8 to 15 μm into the backside layer (see, for example, Kokai No. 7-137464 (page 4)) has been proposed. However, as indicated in its Examples, polyvinyl alcohols in general have a property of absorbing moisture in a high humidity environment and thus this method has a drawback that in the case of a normal paper support, the curl-preventing effect extremely decreases. Furthermore, a method of using a polyvinyl acetal resin, a polyacrylic acid ester resin and a particle having Mohs hardness of 1 to 4 for the backside layer has been proposed (see, for example, Kokai No. 6-239036 (page 2)), but this method is disadvantageous in that the hardness as the filler is too high and when receiving sheets are superposed one on another, the receiving layer in contact with the backside layer is scratched by the filler and thus the output image is deteriorated.

With respect to the method for enhancing the anticurling performance, a method of using an acryl polyol resin and a filler for the backside layer has been proposed (see, for example, Kokai No. 8-118822 (page 2)), but a polyester film is used as the support and water resistance of the acryl polyol itself is disadvantageously not sufficient. Also, a method of providing a water-vapor barrier layer such as vinylidene chloride resin on the back surface of a paper substrate has been disclosed (see, for example, Kokai No. 11-34516 (page 2)), but a chlorine-based resin has a problem in view of environmental consideration.

DISCLOSURE OF THE INVENTION

In a first aspect, the present invention provides a receiving sheet using a paper support mainly comprising cellulose pulp, in which the receiving sheet can overcome a problem of readily causing fusion-bonding of a receiving sheet and an ink ribbon at printing and ensures excellent image uniformity. Also, as described above, the receiving sheet is demanded to cause no fusion-bonding of the backside layer with an ink ribbon at back printing and be free of curling due to fluctuation in the ambient humidity. Accordingly, in a second aspect, the present invention provides a receiving sheet particularly using a paper substrate as the support, in which the receiving sheet has a backside layer assured of anticurling property and back printing suitability over wide environmental conditions.

The present invention in the first aspect includes the following embodiments.

(1) A thermal transfer receiving sheet obtained by sequentially forming a hollow particle-containing intermediate layer and an image receiving layer on one surface of a sheet-like support mainly comprising cellulose pulp, wherein the moisture content of the entire thermal transfer receiving sheet is from 2 to 8 mass % and the moisture permeability of the entire receiving sheet is 400 g/m$^2$·day or less.

(2) The thermal transfer receiving sheet in (1), wherein the image receiving layer mainly comprises a dye-dyeable resin and a crosslinking agent having a water reactive functional group capable of crosslinking the resin.

(3) The thermal transfer receiving sheet in (2), wherein the crosslinking agent having a water reactive functional group is a polyisocyanate compound.

(4) The thermal transfer receiving sheet in any one of (1) to (3), wherein the intermediate layer comprises a polyvinyl alcohol-based resin having a saponification degree of 65 to 90% and a polymerization degree of 200 to 1,000.

(5) The thermal transfer receiving sheet in any one of (1) to (3), wherein the intermediate layer comprises a water-soluble polymer and a water-dispersible resin and the minimum film-forming temperature of the water-dispersible resin is 0° C. or less.

(6) The thermal transfer receiving sheet in (5), wherein the water-soluble polymer is a polyvinyl alcohol-based resin having a saponification degree of 65 to 90% and a polymerization degree of 200 to 1,000.

(7) The thermal transfer receiving sheet in any one of (1) to (6), wherein the dynamic hardness of the intermediate layer is 3.0 mN/(μm)$^2$ or less.

(8) The thermal transfer receiving sheet in any one of (1) to (7), wherein the intermediate layer has a peak in a pore diameter range of 0.01 to 10 μm according to the pore distribution measurement using a mercury press-fitting porosimeter.

(9) The thermal transfer receiving sheet in any one of (1) to (8), wherein the pore volume of the peak region is from 0.01 to 0.7 ml/g.

(10) The thermal transfer receiving sheet in any one of (1) to (9), wherein a barrier layer is further formed between the intermediate layer and the image receiving layer and the barrier layer mainly comprises a swelling inorganic layered compound and an adhesive.

(11) The thermal transfer receiving sheet in any one of (1) to (10), wherein a backside layer is provided on the other surface of the support.

(12) The thermal transfer receiving sheet in (11), wherein the backside layer mainly comprises an acryl-based resin having a glass transition point (Tg) of 45° C. or less and contains a resin filler having an average particle diameter of 5 to 22 μm and the Bekk smoothness according to JIS P 8119 on the backside layer surface is 100 seconds or less.

(13) A method for producing a thermal transfer receiving sheet by sequentially forming a hollow particle-containing intermediate layer and an image receiving layer on one surface of a sheet-like support mainly comprising cellulose pulp, the method comprising, after the sequential formation of a hollow particle-containing intermediate layer and an image receiving layer on one surface of the sheet-like support, adjusting the moisture content of the entire thermal transfer receiving sheet to from 1 to 8 mass %, and then aging the thermal transfer receiving sheet, wherein the moisture permeability of the entire thermal transfer receiving sheet is 400 g/m$^2$·day or less.

(14) The method for producing a thermal transfer receiving sheet in (13), wherein the image receiving layer mainly comprises a dye-dyeable resin and a crosslinking agent having a water reactive functional group capable of crosslinking the resin.

(15) The method for producing a thermal transfer receiving sheet in (14), wherein the crosslinking agent having a water reactive functional group is a polyisocyanate compound.

(16) The method for producing a thermal transfer receiving sheet in any one of (13) to (15), wherein the method comprises a step of further forming a barrier layer between the intermediate layer and the image receiving layer and the barrier layer mainly comprises a swelling inorganic layered compound and an adhesive.

(17) The method for producing a thermal transfer receiving sheet in any one of (13) to (16), which further comprises, after sequentially forming a hollow particle-containing intermediate layer, an arbitrary barrier layer and an image receiving layer on one surface of the sheet-like support, a step of providing a backside layer on the other surface of the support.

(18) The method for producing a thermal transfer receiving sheet as described in (17), wherein the backside layer mainly comprises an acryl-based resin having a glass transition point (Tg) of 45° C. or less and contains a resin filler having an average particle diameter of 5 to 22 μm and the Bekk smoothness according to JIS P 8119 on the backside layer surface is 100 seconds or less.

(19) The method for producing a thermal transfer receiving sheet in any one of (13) to (18), wherein the moisture permeability of the entire sheet-like support before the aging is adjusted to 400 g/m$^2$·day or less.

The present invention in the second aspect includes the following embodiments.

(20) A thermal transfer receiving sheet obtained by sequentially forming a hollow particle-containing intermediate layer and an image receiving layer on one surface of a sheet-like support mainly comprising cellulose pulp and providing a backside layer on another surface of the support, wherein the backside layer mainly comprises an acryl-based resin having a glass transition point (Tg) of 45° C. or less and contains a resin filler having an average particle diameter of 5 to 22 μm and the Bekk smoothness according to JIS P 8119 on the backside layer surface is 100 seconds or less.

(21) The thermal transfer receiving sheet in (20), wherein the content of the resin filler is 2 mass % or more based on the entire solid content of the backside layer.

(22) The thermal transfer receiving sheet in (20) or (21), wherein the main component of the resin filler is at least one member selected from an acryl resin, a polyethylene resin, a starch, a silicone resin and a nylon resin.

(23) The thermal transfer receiving sheet in any one of (20) to (22), wherein a barrier layer containing a swelling inorganic layered compound is further formed between the intermediate layer and the image receiving layer and the swelling inorganic layered compound has an average particle long diameter of 0.5 to 100 μm and an aspect ratio (a ratio of average particle long diameter/thickness of the layered compound) of 5 to 5,000.

BEST MODE FOR CARRYING OUT THE INVENTION

With respect to a receiving sheet using a paper support mainly comprising cellulose pulp and obtained by sequentially stacking an intermediate layer mainly comprising a hollow particle and an adhesive, an arbitrary barrier layer and a receiving layer on one surface of the support and providing an arbitrary backside layer on the side where the receiving layer of the support is not provided, intensive studies have been made to solve the problem that fusion-bonding of the receiving sheet with an ink ribbon readily occurs at printing. As a result, it has been found that when the moisture content of the entire receiving sheet is set to from 2 to 8 mass % and the moisture permeability of the entire receiving sheet is set to 400 g/m$^2$ day or less, a receiving sheet assured of excellent releasability between the receiving layer and the ink ribbon can be obtained.

The releasability between the receiving sheet and the dye layer of an ink ribbon is considered to decrease at printing to generate fusion-bonding because of the following reason. Generally, a crosslinking agent such as polyisocyanate is blended in a receiving layer for the purpose of three-dimensionally crosslinking a release agent or a thermoplastic resin so as to prevent fusion-bonding with the dye layer of an ink ribbon. However, since the moisture contained in paper mainly comprising cellulose pulp selectively reacts with the crosslinking agent, desired three-dimensional crosslinking cannot be achieved, failing in obtaining a sufficiently high effect of preventing fusion-bonding.

In order to prevent this fusion-bonding, the moisture content of the entire receiving sheet before aging needs to be adjusted to from 1 to 8 mass %. The moisture content is preferably from 2 to 6 mass %. Also, it is important to adjust the moisture permeability of the entire receiving sheet to 400 g/m$^2$·day or less. The moisture permeability is preferably from 350 g/m$^2$·day or less. If the moisture content of the entire receiving sheet before aging is less than 1 mass %, the receiving sheet surface comes to have a large irregularity due to shrinkage of the cellulose sheet and the uniformity of image changes for the worse, whereas if the moisture content exceeds 8 mass %, the absolute water volume is large and even when the moisture permeability of the entire receiving sheet is set to 400 g/m$^2$·day or less, the crosslinking agent contained in the receiving layer is readily affected by the moisture. For example, the isocyanate may not be reacted with a desired functional group, giving rise to insufficient three-dimensional crosslinking and reduction in the releasing performance from the ribbon.

The water content of the entire receiving sheet can be adjusted, for example, by controlling the coating/drying conditions in the step of forming the receiving sheet, such as temperature, time and air flow. Also, the moisture permeability of the entire receiving sheet can be adjusted, for example, by selecting the adhesive resin such as water-soluble resin (also referred to as a "water-soluble polymer") and water-dispersible resin, the pigment or the like used in the intermediate layer or barrier layer, or by appropriately selecting the coating conditions or the like.

In the manufacturing process, after the formation of the receiving layer, the moisture permeability of the receiving sheet before aging is preferably 400 g/m$^2$·day or less, more preferably 350 g/m$^2$·day or less. If the moisture permeability exceeds 400 g/m$^2$·day, the crosslinking agent contained in the receiving layer is readily affected by the water content during aging and the quality may not be stabilized. The moisture permeability of the receiving sheet before aging is nearly the same as, for example, the moisture permeability after a barrier layer is formed on the sheet-like support, and it is also possible to measure the moisture permeability after the formation of a barrier layer.

The moisture content (indicated by %; also referred to as a "percentage of moisture content") can be measured according to JIS P 8127, and the moisture permeability can be measured according to JIS K 7129 by a moisture permeability automatic measuring apparatus (L80-4000, trade name, manufactured by Risshi Co., Ltd.).

The aging conditions are sufficient if the temperature is in a range of causing no blocking of the receiving layer. The aging conditions are generally a temperature of approximately from 40 to 60° C. and 24 hours or more, and a sufficiently high effect is obtained by aging for about 50 hours.

It has been also found that in the case where a water-soluble polymer and a water-dispersible resin or the like are used as the adhesive for the intermediate layer, when the minimum film-forming temperature of the water-dispersible resin is 0° C. or less, the moisture permeability of the receiving sheet more decreases and the fusion-bonding can be more easily avoided. This is considered attributable to the fact that as the minimum film-forming temperature is lower, a uniform film can be more readily formed and the amount of moisture permeated can be more reduced.

Furthermore, the effect is found to be more enhanced when the barrier layer mainly comprises a swelling inorganic layered compound and an adhesive. This is considered to result because the swelling inorganic layered compound is highly crystalline and by virtue of stacking a large number of lamellas in the barrier layer, an effect of detouring the water content is imparted.

The constituent layers of the receiving sheet according to the present invention are described in detail below.

(Sheet-Like Support)

The sheet-like support for use in the receiving sheet of the present invention is paper sheets mainly comprising cellulose pulp. Specific examples of the paper sheets include an uncoated paper sheet such as wood-free paper and medium quality paper, a coated paper sheet such as coated paper, art paper and cast-coated paper, a laminate paper sheet obtained by providing a thermoplastic resin layer (e.g., polyolefin resin) on at least one surface of base paper, a synthetic resin-impregnated paper sheet, and a paper board. The sheet-like support may be subjected to calendering for the purpose of obtaining high smoothness.

The sheet-like support for use in the present invention preferably has a thickness of 50 to 250 μm. If the thickness is less than 50 μm, insufficient mechanical strength may result and the receiving sheet obtained therefrom comes to have low rigidity and exhibit unsatisfactory repulsion to deformation, as a result, curling of the receiving sheet may not be sufficiently prevented from occurrence at printing. If the thickness exceeds 250 μm, the obtained receiving sheet comes to have an excessively large thickness and the number of receiving sheets housed in a printer may decrease or in the case of housing a predetermined number of receiving sheets, this requires increase in the printer capacity and there may arise a problem such as difficulty in downsizing a printer.

(Intermediate Layer)

In the present invention, the intermediate layer provided on the sheet-like support comprises a hollow particle having specific physical properties and an adhesive.

By dispersing or distributing a hollow particle in the intermediate layer, the receiving sheet can be decreased in the compressive modulus of elasticity, an appropriate latitude of deformation is allowed for the receiving sheet, and the followability, close contact or the like of the receiving sheet to the printer head shape and ink ribbon shape are enhanced, so that the heat efficiency of a thermal head for the receiving layer can be enhanced even in a low energy state and the printing density and image quality of an image printed can be elevated. At the same time, a printing failure ascribable to ink ribbon wrinkling generated on an ink ribbon in a state of a high energy being applied to a high-speed printer can be also prevented.

(Hollow Particle)

The hollow particle for use in the intermediate layer of the present invention comprises a shell formed of a polymer material and one or more hollow (pore) part surrounded by the shell. The production method of the hollow particle is not particularly limited, but the hollow particle may be selected from those produced as follows:

(i) a foamed hollow particle produced by thermally expanding a thermoplastic polymer material containing a thermally expansible substance (hereinafter simply referred to as a "prefoamed hollow particle"); and (ii) a microcapsule-like hollow particle obtained by volatilizing and dissipating a pore-forming material from a microcapsule which is produced by a microcapsule polymerization method using a polymer-forming material as the shell-forming material and using a volatile liquid as the pore-forming material (hereinafter simply referred to as a "microcapsule-like hollow particle").

In the intermediate layer of the present invention, the prefoamed hollow particle is preferably used. The prefoamed hollow particle is obtained, for example, as follows. A particle is produced by enclosing a volatile low boiling point hydrocarbon (such as n-butane, i-butane, pentane and/or neopentane) as the thermally expansible substance in a thermoplastic polymer material and using a homopolymer or copolymer of vinylidene chloride, vinyl chloride, acrylonitrile, methacrylonitrile, styrene, (meth)acrylic acid, (meth)acrylic acid ester or the like as the thermoplastic material working out to the shell (wall) material, and the particle produced is thermally expanded to a predetermined particle size by previously applying thereto a treatment such as heating.

The prefoamed hollow particle produced as above generally has a low specific gravity and therefore, for the purpose of enhancing the dispersibility and the like and improving the handleability and operability, an inorganic powder such as calcium carbonate, talc and titanium dioxide may be attached by heat fusion to the surface of the prefoamed hollow particle. A prefoamed composite hollow particle or the like with the surface being coated by an inorganic powder, obtained in this way, may also be used in the present invention.

The microcapsule-like hollow particle preferably used in the intermediate layer of the present invention is obtained by a microcapsule-forming polymerization method where a microcapsule having a shell (wall) formed of a polymer-forming material (shell-forming material) and containing a volatile liquid (pore-forming material) in the core part is dried and the pore-forming material is thereby volatilized and dissipated to form a hollow core part. As for the polymer-forming material, a hard resin such as styrene-(meth)acrylic acid ester-based copolymer and melamine resin is preferably used, and as for the volatile liquid, water or the like is used.

The hollow particle (prefoamed hollow particle, microcapsule-like hollow particle) for use in the present invention preferably has an average particle diameter of 0.5 to 10 μm, more preferably from 1 to 9 μm, and most preferably from 2 to 8 μm. If the average particle diameter of the foamed hollow particle is less than 0.5 μm, the hollow percentage by volume of the hollow particle is generally low and therefore, the effect of enhancing the sensitivity of the receiving sheet may not be brought out, whereas if the average particle diameter exceeds 10 μm, the obtained intermediate layer surface may be reduced in the smoothness and the thermally transferred image may suffer from defective uniformity and insufficient expression of gloss.

Incidentally, the average particle diameter of the hollow particle can be measured by using a general particle diameter measuring apparatus and, for example, the average particle diameter is measured by using a laser diffraction-type particle size distribution analyzer (SALD2000, trade name, manufactured by Shimadzu Corporation).

The hollow percentage by volume of the hollow particle for use in the present invention is preferably from 50 to 97%, more preferably from 55 to 95%. If the hollow percentage by volume of the hollow particle is less than 50%, the effect of enhancing the sensitivity of the entire receiving sheet cannot be sufficiently exerted, whereas if the hollow percentage by volume exceeds 97%, there arise a problem that the coating strength of the intermediate layer decreases, the intermediate layer is readily scratched, or the outer appearance is worsened.

Here, the hollow percentage by volume of the hollow particle indicates a ratio of the volume in the hollow portion to the particle volume. Specifically, the hollow percentage by volume can be obtained from the specific gravity of a hollow particle liquid dispersion comprising a hollow particle and a anti-solvent, the partial ratio by mass of the hollow particle in the liquid dispersion, the true specific gravity of the polymer resin constituting the shell (wall) of the hollow particle, and the specific gravity of the anti-solvent. The anti-solvent is a solvent incapable of dissolving and/or swelling the resin constituting the wall of the hollow particle, and examples thereof include water and isopropyl alcohol. The average particle diameter or hollow percentage by volume of the hollow particle may also be determined from a cross-sectional photograph of the hollow particle-containing intermediate layer by using, for example, a small-angle X-ray scattering measuring apparatus (RU-200, trade name, produced by Rigaku Corporation).

In the intermediate layer of the present invention, the ratio by mass of the hollow particle to the entire solid content of the intermediate layer is preferably from 20 to 80 mass %, more preferably from 25 to 70 mass %. If the ratio by mass of the hollow particle is less than 20 mass %, the effect of enhancing the sensitivity of the receiving sheet may be insufficient, whereas if the ratio by mass of the hollow particle exceeds 80 mass %, the coatability of the coating solution for the intermediate layer may be worsened, failing in obtaining a good coated surface, or the coating strength of the intermediate layer may decrease.

(Adhesive)

In the intermediate layer, an adhesive resin needs to be blended for enhancing the coating strength of the intermediate layer. The adhesive resin is not particularly limited and, for example, a water-soluble polymer such as polyvinyl alcohol-based resin, casein, soybean protein, synthetic proteins, starch, cellulose-based resin and its derivative is preferably used in view of film-forming property and heat resistance. Also, other various adhesive resins generally known and commonly used in the coated paper field, including a water-dispersible resin such as conjugated diene-based polymer latex (e.g., styrene-butadiene copolymer, methyl methacrylate-butadiene copolymer) and vinyl-based copolymer (e.g., styrene-vinyl acetate copolymer), an aqueous acryl resin, an aqueous polyurethane resin and an aqueous polyester resin, may be used as a water-dispersible resin with low viscosity and high solid content. One of these water-soluble polymers or water-dispersible resins may be used alone, or two or more species thereof may be used in combination.

As for the water-soluble polymer used in the intermediate layer, among the resins above, a polyvinyl alcohol (PVA)-based resin is preferred, and a polyvinyl alcohol-based resin having a saponification degree of 65 to 90% and a polymerization degree of 200 to 1,000 is more preferred because the moisture permeability of the receiving sheet is more decreased and the effect of preventing fusion-bonding with the ribbon is also excellent. The reason why such a polyvinyl alcohol-based resin is preferably used in the intermediate layer is considered as follows. For example, the hollow particle in the coating material for the intermediate layer exhibits good dispersibility or such a coating material for the intermediate layer is suitable also in view of viscosity, so that excellent coating film formability can be achieved at the coating of the intermediate layer, a more uniform intermediate layer can be formed, or the amount of water content permeated can be more decreased.

The water-dispersible resin for the intermediate layer preferably has a minimum film-forming temperature of 0° C. or less. If the minimum film-forming temperature exceeds 0° C., a satisfactory film cannot be formed in the intermediate layer, resulting in a non-uniform film, and the water content migrates, that is, the moisture permeability is increased. On the other hand, if the minimum film-forming temperature is excessively low, blurring of the image may be worsened. Examples of the water-dispersible acryl resin having a minimum film-forming temperature of 0° C. or less include E-377 (trade name) produced by JSR Corp., and FK4025 (trade name) produced by CSC Co., Ltd.

Preferably, a water-soluble polymer and a water-dispersible resin are used in combination. The blending ratio between the water-soluble polymer and the water-dispersible resin is not particularly limited, but the water-dispersible resin is preferably blended in an amount of 100 to 800 parts by mass per 100 parts by mass of the water-soluble polymer. If the water-dispersible resin is less than 100 parts by mass, the viscosity of the coating material increases and a sufficiently smooth surface may not be obtained, whereas if it exceeds 800 parts by mass, the film-forming property or heat resistance may be deteriorated.

In the intermediate layer, if desired, one species or two or more species appropriately selected from various adjuvants such as defoaming agent, a colorant, antistatic agent, antiseptic, dispersant, thickener and resin crosslinking agent may be added.

For allowing the intermediate to exert desired performances such as heat insulating property, cushioning property and enhancement of gloss, the thickness of the intermediate layer is preferably from 20 to 90 μm, more preferably from 25 to 85 μm. If the thickness of the intermediate layer is less than 20 μm, insufficient heat insulating property or cushioning property may result and the effect of enhancing the sensitivity or image quality may be unsatisfied, whereas if the thickness exceeds 90 μm, the heat insulating or cushioning effect may be saturated, failing in elevating the performance any more, and this is disadvantageous also in view of profitability.

Furthermore, the thickness of the intermediate layer is preferably 3 times or more, more preferably 4 times or more, the average particle diameter of the hollow particle contained in the intermediate layer. If the thickness of the intermediate layer is less than 3 times the average particle diameter of the hollow particle contained in the intermediate layer, a coarse hollow particle may protrude from the intermediate layer surface and this may disadvantageously incur reduction in the image uniformity and gloss.

In the present invention, the hollow particle-containing intermediate layer has high heat insulating property and cushioning property, and the cushioning property can be specified by the "dynamic hardness". In general, the hardness of a thin film is determined by the distortion when a static load is vertically applied to the material surface. In the present invention, the dynamic hardness of the intermediate layer is a value measured by using, for example, an ultramicro-hardness meter (DUH-201H, trade name, manufactured by Shimadzu Corporation). A load is applied to a 115° triangular pyramid indenter and from the load and the indentation depth of indenter, the dynamic hardness can be determined according to the following formula:

$$\text{Dynamic hardness } DHT_{115=3.7838} \times P/h^2$$

wherein P: load (mN) and h: indentation depth (μm).

This measurement method is a method of measuring the hardness by converting microfine movement of a needle-like indenter into electric signal, and the hardness in a desired indentation depth can be determined by adjusting the load. The method for measuring the dynamic hardness of the intermediate layer in the receiving sheet includes a method of previously shaving off the stacked receiving layer by a razor or the like and measuring the hardness in a state of the intermediate layer being exposed, or a method of measuring the hardness while the receiving layer is stacked. Either of these methods is applicable in the present invention. For example, in the method of measuring the hardness while the receiving layer is stacked, the hardness may be measured after the coating thickness of the receiving layer is previously measured, for example, by observing an enlarged tomographic photograph and the load is set to give an indentation depth larger than the thickness of the receiving layer.

In the present invention, the dynamic hardness of the intermediate layer is preferably 3.0 or less, more preferably from 0.1 to 1.0. If the dynamic hardness exceeds 3.0, the cushioning property as the intermediate layer is insufficient, giving rise to poor adhesion to a thermal head at printing, and the image quality may decrease, whereas if the dynamic hardness is excessively small, for example, less than 0.1, the handleability may be deteriorated due to easy scratching.

In the present invention, the method for setting the dynamic hardness of the intermediate layer to 3.0 or less includes, but is not limited to, the following methods:

(1) a method using a hollow particle having a small division wall thickness as the hollow particle contained in the intermediate layer, where the hollow particle deforms while maintaining the hollow on receiving a load and where the division wall thickness of the hollow particle is preferably 10 μm or less, more preferably 2 μm or less; and (2) a method of incorporating a hollow particle into the intermediate layer and at the same time, adding a resin having a softening point lower than the ordinary temperature, where the soft resin has an effect of decreasing the hardness of the entire intermediate layer and where the softening point of the resin is preferably 30° C. or less, more preferably 10° C. or less.

The intermediate layer of the present invention preferably has a peak in a pore diameter range of 0.01 to 10 μm according to the pore distribution measurement using a mercury press-fitting porosimeter and may have two or more peaks in this range. Furthermore, the cumulative pore volume of this peak region is preferably from 0.01 to 0.7 ml/g. In general, it is considered that as the pore volume is larger, the heat insulating property or cushioning property of the intermediate layer is increased and the recording sensitivity is enhanced. However, in the case where the pore diameter at the peak in the pore distribution of the intermediate layer exceeds 10 μm or where the cumulative pore volume of the peak region exceeds 0.7 ml/g, at the time of forming a receiving layer (or a barrier layer or the like) on the intermediate layer, the coating solution may excessively permeate the intermediate layer to fail in forming a film and a uniform coating layer may not be obtained. On the other hand, in the case where the pore diameter at the peak is less than 0.01 μm or where the cumulative pore volume is less than 0.01 ml/g, the coating solution may not appropriately permeate the intermediate layer and the coating layer may be non-uniform or deficient in the adhesive strength, as a result, for example, the coating layer may come off due to fusion-bonding or the like with an ink ribbon.

The method for measuring the pore distribution of the intermediate layer by a mercury press-fitting porosimeter is described below, but the present invention is not limited to these methods:

(1) a method where the pore distribution is measured by using a mercury press-fitting porosimeter with respect to two members, that is, a sheet-like support mainly comprising cellulose pulp and an intermediate layer-coated product prepared by coating up to the intermediate layer on the above-described support, and the pore distribution of the intermediate coating layer is specified from a subtraction between two pore distributions obtained;

(2) a method where an intermediate layer-coated product is prepared by coating up to an intermediate layer on a sheet-like support mainly comprising cellulose pulp and the pore distribution of a powder obtained by shaving the coating layer of the intermediate layer-coated product with a razor or the like is measured by using a mercury press-fitting porosimeter; and (3) a method where the coating layers of receiving layer and barrier layer of a receiving sheet of the present invention obtained by sequentially stacking an intermediate layer, a barrier layer, if desired, and a receiving layer on a sheet-like support mainly comprising cellulose pulp each is removed with a razor or the like to expose the intermediate layer, and the pore distribution of a powder obtained by shaving the exposed intermediate coating layer with a razor or the like is measured by using a mercury press-fitting porosimeter. In this case, it can be confirmed by the observation of a cross-sectional enlarged photograph that the receiving layer and the barrier layer are removed and the intermediate layer is exposed.

In the intermediate layer of the present invention, the method for adjusting the peak range of pore diameter or the pore volume of peak region to a desired range is not particularly limited but, for example, such adjustment can be easily achieved by selecting the construction material, average particle diameter (preferably inner diameter) or the like of the hollow particle contained in the intermediate layer, selecting the adhesive, or appropriately setting the ratio by mass or the like between the hollow particle and the adhesive.

In the preparation of the coating solution for the hollow particle-containing intermediate layer, the coating solution is usually prepared to have a specific gravity of preferably 0.8 $g/cm^3$ or less, more preferably 0.7 $g/cm^3$ or less.

(Barrier Layer)

In the present invention, a barrier layer is preferably provided between the intermediate layer and the receiving layer. The solvent used in the coating solution for the receiving layer is generally an organic solvent such as toluene and methyl ethyl ketone and therefore, the barrier layer is effective as a barrier for preventing the hollow particle in the intermediate layer from deforming or collapsing through swelling or dissolution due to permeation of the organic solvent.

As for the resin used in the barrier layer, a resin excellent in the film-forming ability, capable of preventing permeation of an organic solvent and assured of elasticity and flexibility is used. More specifically, a water-soluble resin such as starch, modified starch, hydroxyethyl cellulose, methyl cellulose, carboxymethyl cellulose, gelatin, casein, gum arabic, completely saponified polyvinyl alcohol, partially saponified polyvinyl alcohol, carboxy-modified polyvinyl alcohol, acetoacetyl group-modified polyvinyl alcohol, ethylene vinyl alcohol copolymer, diisobutylene-maleic anhydride copolymer salt, styrene-maleic anhydride copolymer salt, styrene-acrylic acid copolymer salt, ethylene-acrylic acid copolymer salt, urea resin, urethane resin, melamine resin or amide resin, is used. Also, a water-dispersible resin such as styrene-butadiene-based copolymer latex, acrylic acid ester resin-based latex, methacrylic acid ester-based copolymer resin latex, ethylene-vinyl acetate copolymer latex, polyester polyurethane ionomer and polyether polyurethane ionomer, may be used.

Among these resins, a water-soluble polymer is generally preferred and, for example, a polyvinyl alcohol such as completely saponified polyvinyl alcohol and partially saponified polyvinyl alcohol, an ethylene vinyl alcohol copolymer and a styrene-acrylic acid copolymer salt are more preferred.

The barrier layer may contain various pigments, and a swelling inorganic layered compound is preferably used. This compound provides not only an effect of preventing the permeation of the solvent for coating but also an excellent effect of preventing blurring or the like of the thermally transferred and dyed image. The swelling inorganic layered compound includes a natural clay-type mineral such as smectite group, mica group and vermiculite group. Other than the clay-type mineral as a natural product, the compound may be either a synthetic product or a processed product (for example, a surface-treated silane coupling agent).

With respect to the synthetic swelling inorganic layered compound, for example, a synthetic mica such as fluorophlogopite ($KMg_3AlSi_3O_{10}F$, melting process or solid-phase reaction process), potassium tetrasilicon mica ($KMg_{25}Si_4O_{10}F_2$, melting process), sodium tetrasilicon mica ($NaMg_{2.5}Si_4O_{10}F_2$, melting process), sodium taeniolite ($NaMg_2LiSi_4O_{10}F_2$, melting process) and lithium taeniolite ($LiMg_2LiSi_4O_{10}F_2$, melting process), or a synthetic smectite such as sodium hectorite ($Na_{0.33}Mg_{2.67}Li_{0.33}Si_{4.0}O_{10}(OH \text{ or } F)_2$, hydrothermal reaction process or melting process), lithium hectorite ($Na_{0.33}Mg_{2.67}Li_{0.33}Si_{4.0}O_{10}(OH \text{ or } F)_2$, hydrothermal reaction process or melting process) and saponite ($Na_{0.33}Mg_{2.67}AlSi_{4.0}O_{10}(OH)_2$, hydrothermal reaction process), is preferably used.

Among these, sodium tetrasilicon mica is preferred. Those having desired particle diameter, aspect ratio and crystallinity can be obtained by a melting synthesis process.

A swelling inorganic layered compound having an aspect ratio of 5 to 5,000 is preferably used. The aspect ratio is more preferably from 100 to 5,000, still more preferably from 500 to 5,000. If the aspect ratio is less than 5, blurring of the image may occur, whereas if the aspect ratio exceeds 5,000, the image may have poor uniformity. The aspect ratio (Z) is expressed by the relationship of $Z=L/a$, wherein L is an average particle long diameter of the swelling inorganic layered compound in water (as measured by a laser diffraction method using a particle size distribution meter, LA-910, manufactured by Horiba Ltd.; a median diameter at 50% in the volume distribution), and a is a thickness of the swelling inorganic layered compound.

The thickness a of the swelling inorganic layered compound is a value obtained by photographic observation of the cross-section of the barrier layer through a scanning electron microscope (SEM) or a transmission electron microscope (TEM). The average particle long diameter of the swelling inorganic layered compound is from 0.1 to 100 μm, preferably from 0.3 to 50 μm, more preferably from 0.5 to 20 μm. If the average particle long diameter is less than 0.1 μm, the aspect ratio becomes small and at the same time, the compound can be hardly spread in parallel on the intermediate layer, giving rise to failure in completely preventing blurring of the image. If the average particle long diameter exceeds 100 μm, the swelling inorganic layered compound protrudes from the barrier layer to create an irregularity on the barrier layer surface, as a result, the smoothness on the receiving layer surface may decrease and the image quality may be worsened.

In the barrier layer, an inorganic pigment such as inorganic white pigment (e.g., calcium carbonate, titanium dioxide, zinc oxide, aluminum hydroxide, barium sulfate, silicon dioxide, aluminum oxide, talc, kaolin, diatomaceous earth, satin white), a fluorescent dye or the like may be incorporated so as to impart masking property or whiteness or improve the texture of the receiving sheet.

The barrier layer of the present invention is preferably formed by using an aqueous coating solution. In order to prevent swelling and dissolution of the hollow particle, the aqueous coating solution preferably contains no large excess of an organic solvent such as ketone-based solvent (e.g., methyl ethyl ketone), ester-based solvent (e.g., ethyl acetate), lower alcohol-based solvent (e.g., methyl alcohol, ethyl alcohol), hydrocarbon-based solvent (e.g., toluene, xylene), and high boiling point high-polarity solvent (e.g., dimethylformamide (DMF), cellosolve).

The coated amount in terms of solid content of the barrier layer is preferably from 0.5 to 8 g/m$^2$, more preferably from 1 to 7 g/m$^2$, still more preferably from 1 to 6 g/m$^2$. If the coated amount in terms of solid content of the barrier layer is less than 0.5 g/m$^2$, the barrier layer cannot completely cover the intermediate layer surface in some cases and the effect of preventing permeation of an organic solvent may be insufficient. On the other hand, if the coated amount in terms of solid content of the barrier layer exceeds 8 g/m$^2$, not only the coating effect is saturated and this is unprofitable but also the thickness of the barrier layer becomes excessively large, as a result, the heat insulating effect or cushioning property of the intermediate layer may not be fully brought out and the image density may decrease.

(Receiving Layer)

In the receiving sheet of the present invention, a receiving layer is provided on the barrier layer. The receiving layer itself may be a known dye thermal transfer receiving layer. As for the resin constituting the receiving layer, a resin having high affinity for the dye migrating from the ink ribbon and accordingly having good dye-dyeability is used. Examples of such a dye-dyeable resin include a thermoplastic resin and an active energy ray-curable resin, such as polyester resin, polycarbonate resin, polyvinyl chloride resin, vinyl chloride-vinyl acetate copolymer resin, polyvinyl acetal resin, polyvinyl butyral resin, polystyrene resin, polyacrylic acid ester resin, cellulose derivative-based resin (e.g., cellulose acetate butyrate), and polyamide resin. Such a resin preferably has a functional group reactive with the crosslinking agent used (for example, a functional group such as hydroxyl group, amino group, carboxyl group and epoxy group).

In the receiving layer of the present invention, a crosslinking agent such as polyisocyanate compound is blended for the purpose of three-dimensionally crosslinking the above-described dye-dyeable resin so as to prevent the receiving layer from fusion-bonding with the ink ribbon at printing due to heating in a thermal head. Also, one or more species of a crosslinking agent other than the isocyanate compound, a release agent, a slipping agent and the like may be blended as the additive in the receiving layer. Furthermore, if desired, one or more species of a fluorescent dye, a plasticizer, an antioxidant, a pigment, a filler, an ultraviolet absorbent, a light stabilizer, an antistatic agent and the like may be added to the receiving layer. Such an additive may be mixed with the constituent components of the receiving layer before coating or may be coated on and/or under the receiving layer as a separate coating layer different from the receiving layer.

The receiving layer is formed by appropriately dissolving or dispersing a dye-dyeable resin and necessary additives such as release agent, for example, a release agent such as amino-modified or hydroxy-modified silicone oil, silicone-based resin (e.g., acryl silicone resin), silicone oil and fatty acid ester compound, a crosslinking agent such as isocyanate-based compound and epoxy-based compound, a plasticizer such as phthalic acid ester type, aliphatic dibasic acid ester type, trimellitic acid ester type, phosphoric acid ester type, epoxy type and polyester type, and an ultraviolet absorbent, in an organic solvent to prepare a coating solution for the receiving layer, coating and drying the coating solution with use of a known coater on a sheet-like support having provided thereon a barrier layer, and, if desired, aging the stack under heating.

The coated amount in terms of solid content of the receiving layer is preferably from 1 to 12 g/m$^2$, more preferably from 3 to 10 g/m$^2$. If the coated amount in terms of solid content of the receiving layer is less than 1 g/m$^2$, the receiving layer cannot completely cover the barrier layer surface in some cases and the image quality may decrease or a fusion-bonding trouble that the receiving layer and the ink ribbon are bonded due to heating in a thermal head may occur. On the other hand, if the coated amount in terms of solid content exceeds 12 g/m$^2$, not only the coating effect is saturated and this is unprofitable but also the receiving layer comes to have insufficient coating strength or excessively large coating thickness, as a result, the heat insulating effect of the intermediate layer may not be fully exerted and the image density may decrease.

(Backside Layer)

In the receiving sheet of the present invention, a backside layer mainly comprising a polymer resin may be provided on the back surface (the surface opposite the side where the receiving layer is provided) of the sheet-like support. This polymer resin is effective for enhancing the adhesive strength between the backside layer and the support, ensuring printing/transporting performance of the receiving sheet, preventing scratching on the receiving layer surface, and preventing migration of a dye to the backside layer coming into contact with the receiving layer. As for such a resin, for example, an acryl resin, an epoxy resin, a polyester resin, a phenol resin, an alkyd resin, a urethane resin, a melamine resin, a polyvinyl acetal resin or a reaction cured product of such a resin may be used. Also, the backside layer may appropriately contain a crosslinking agent such as polyisocyanate compound and epoxy compound for the purpose of enhancing the adhesion between the sheet-like support and the backside layer.

In the backside layer, an organic or inorganic filler is preferably blended as a frictional coefficient regulator. Examples of the organic filler which can be used include nylon filler, cellulose filler, urea resin filler, styrene resin filler and acryl resin filler. Examples of the inorganic filler which can be used include silica, barium sulfate, kaolin, clay, talc, heavy calcium carbonate, precipitated calcium carbonate, titanium oxide and zinc oxide.

In the backside layer, an electrically conducting agent such as electrically conducting polymer and electrically conducting inorganic pigment may be added for the purpose of enhancing the printing/transporting performance or preventing electrostatic charge. The electrically conducting polymer is preferably a cationic electrically conducting polymer compound (e.g., polyethyleneimine, cationic monomer-containing acryl-based polymer, cation-modified acrylamide polymer, cationic starch).

The backside layer may contain a fusion-bonding inhibitor such as release agent and lubricant, if desired. Examples of the release agent include a silicone-based compound such as non-modified or modified silicone oil, silicone block copolymer and silicone rubber, and examples of the lubricant include a phosphoric acid ester compound, a fatty acid ester compound and a fluorine compound. Furthermore, conventionally known defoaming agent, dispersant, colored pigment, fluorescent dye, fluorescent pigment, ultraviolet absorbent and the like may be appropriately selected and used.

With respect to a thermal transfer receiving sheet having a backside layer, which is a receiving sheet using, as the sheet-like support, a paper substrate mainly comprising cellulose pulp, intensive studies have been made to prevent curling due to fluctuation of the ambient humidity, as a result, it has been found that the glass transition point (Tg) of the adhesive used in the backside layer has great effect on the curling of receiving sheet.

In general, an acrylic acid-based resin is excellent in heat resistance and water resistance and used also as an adhesive for the backside layer, but in the present invention, it is important that an acryl-based resin having a Tg of 45° C. or less is contained as an adhesive in the backside layer. The Tg of the acryl-based resin is more preferably 30° C. or less, still more preferably from −10 to 30° C. If the Tg of the acryl-based resin exceeds 45° C., the film-forming property at the coating of the backside layer becomes insufficient and a tough film with high elasticity can be hardly formed. On the other hand, if the Tg is excessively low, when the receiving sheets are superposed one on another to bring the backside layer surface into contact with the receiving layer surface, blocking is liable to occur.

The acryl-based resin for use in the present invention is a copolymer synthesized by using an acrylic acid ester-based monomer of various types as the main component, and this monomer is appropriately selected from various acrylic acid ester-based monomers such as acrylic acid ester and methacrylic acid. Examples thereof include methyl methacrylate, ethyl methacrylate, propyl methacrylate, butyl methacrylate, ethylhexyl methacrylate, octyl methacrylate, isodecyl methacrylate, lauryl methacrylate, tridecyl methacrylate, stearyl methacrylate, cyclohexyl methacrylate and benzyl methacrylate. Furthermore, a reactive group can be introduced into the acryl-based resin for use in the present invention. Examples of the reactive group include an amino group, a carboxyl group and a hydroxyl group.

As for the Tg adjustment of the acryl-based resin, an acryl-based resin having a desired Tg can be appropriately designed by selecting Tg of various monomers described in pertinent academic documents such as The Society of Polymer Science, Japan (compiler), Kobunshi no Bussei II, Kobunshi Jikkengaku Koza 4 (Physical Properties of Polymers II, Polymer Experiment Course 4), page 51, Kyoritsu Shuppan (1959), and applying it to the Fox formula ($1/Tg=\Sigma wi/Tgi$, wherein "wi" represents a mass fraction of each component, and "Tgi" represents Tg of each component).

Specific examples of the acryl-based resin for use in the present invention include Polysol AT731 (a methacrylic acid ester copolymer, Tg: 0° C.), trade name, produced by Showa Highpolymer Co., Ltd.; AT510 (an acrylic acid ester copolymer, Tg: 28° C.), SEK301 (a methacrylic acid ester polymer emulsion, Tg: 18° C.) and ET410 (an acrylic acid ester copolymer, Tg: 44° C.), trade names, produced by Nihon Junyaku Co., Ltd.; and FK420 (an acryl copolymer, Tg: 40° C.), trade name, produced by CSC Co., Ltd.

Incidentally, the glass transition point (Tg) of the acryl-based resin for use in the present invention is a value measured according to the method prescribed in JIS K 7121 by using a differential scanning calorimeter (SSC5200, trade name, manufactured by Seiko Electronic Industry).

In the present invention, in order to prevent fusion-bonding of the backside layer with an ink ribbon at back printing, the backside layer contains a resin filler having an average particle diameter of 5 to 22 μm. The average particle diameter of the resin filler is preferably from 8 to 20 μm, more preferably from 8 to 15 μm. If the average particle diameter is less than 5 μm, the backside layer is deficient in slipperiness and the fusion-bonding at back printing cannot be sufficiently prevented, whereas if it exceeds 22 μm, when receiving sheets are superposed one on another, a press mark of a large particle-diameter filler leaves on the receiving layer put into contact with the backside layer and this adversely affects the printed image.

The content of the resin filler in the backside layer is necessarily 2 mass % or more, preferably from 2 to 20 mass %, based on the entire solid content of the backside layer. If the amount of the resin filler added is less than 2 mass %, insufficient slipperiness sometimes results, whereas if the amount of the resin filler added is excessively large, the proportion of the acryl-based resin in the backside layer decreases and therefore, the anticurling effect of the film may not be fully brought out.

The average particle diameter of the resin filler is measured by using a particle diameter measuring device (SALD2000, trade name, manufactured by Shimadzu Corporation).

Examples of the composition of the resin filler include an acryl resin, a polyethylene resin, a polypropylene resin, a starch, a silicone resin, a nylon resin, a fluorine-based resin (e.g., tetrafluoroethylene), a benzoguanamine resin, a polyurethane resin and a styrene-butadiene copolymer resin. In particular, a filler comprising an acryl resin, a polyethylene resin, a starch, a silicone resin, a nylon resin or the like is preferred, and a filler comprising an acryl resin, a polyethylene resin, a starch, a silicone resin or the like is more preferred.

As for the smoothness on the backside layer surface, the Bekk smoothness according to JIS P 8119 is necessarily 100 seconds or less, preferably from 5 to 50 seconds, more preferably from 5 to 30 seconds. If the Bekk smoothness on the backside layer surface exceeds 100 seconds, when receiving sheets are superposed one on another to put the backside layer into contact with the receiving layer, the receiving layer is readily scratched and a white spot may be generated on the print.

The coated amount in terms of solid content of the backside layer is preferably from 0.3 to 10 g/m$^2$, more preferably from 1 to 8 g/m$^2$. If the coated amount in terms of solid content of the backside layer is less than 0.3 g m$^2$, the receiving sheet when rubbed cannot be satisfactorily prevented from scratching and also, traveling failure of the receiving sheet may occur, whereas if the coated amount in terms of solid content exceeds 10 g/m$^2$, the effect is saturated and this is unprofitable.

In the present invention, the receiving sheet may be subjected to calendering and casting treatments, and the receiving layer surface may be reduced in the irregularity or may be smoothened. The calendering and casting treatments may be performed at any stage after the intermediate layer, barrier layer or receiving layer is coated. The calendering apparatus, nip pressure, number of nips, surface temperature of metal roll, and the like used in the calendering treatment are not particularly limited, but the pressure condition when applying a calendering treatment is preferably from 0.5 to 50 MPa, more preferably from 1 to 30 MPa. The casting apparatus, nip pressure, surface temperature of cast roll, and the like used in the casting treatment are also not particularly limited, but the temperature condition is preferably from room temperature to a temperature not causing rupture of the hollow particle and at the same time, being less than the melting point of the adhesive for the intermediate layer, that is, preferably from 20 to 150° C., more preferably from 30 to 130° C. As for the calendering apparatus, a calendering apparatus generally used in the paper-making industry, such as super calender, soft calender, gloss calender and clearance calender, may be appropriately used.

The thickness of the entire receiving sheet is preferably from 100 to 300 μm. If this thickness is less than 100 μm, the mechanical strength and rigidity of the receiving sheet may be insufficient and in some cases, the receiving sheet cannot be satisfactorily prevented from curling generated at printing, whereas if the thickness exceeds 300 μm, the number of receiving sheets which can be housed in a printer may decrease or in the case of housing a predetermined number of receiving sheets, this requires increase in the capacity of the receiving sheet-housing part and there may arise a problem such as difficulty in downsizing a printer.

(Manufacturing Method of Thermal Transfer Receiving Sheet)

In the present invention, the intermediate layer, the barrier layer, the receiving layer, the backside layer and other coating layers are formed according a conventional method and each layer may be formed by preparing a coating solution containing required components, coating the coating solution on the predetermined surface of a sheet-like support by use of a known coater such as bar coater, gravure coater, comma coater, blade coater, air knife coater, gate roll coater, die coater, curtain coater, lip coater and slide bead coater, and drying the coating.

EXAMPLES

The present invention is described in greater detail below by referring to Examples, but the scope of the present invention is not limited thereto. In Examples, unless otherwise indicated, the "%" and "parts" indicate "mass %" and "parts by mass" in terms of solid content, excluding those for solvents.

Example 1

Formation of Intermediate Layer

Using a 150 μm-thick art paper (OK Kanefuji N, trade name, produced by Oji Paper Co., Ltd., 174.4 g/m$^2$) as the sheet-like support, Coating Solution 1 for Intermediate Layer having the following composition was coated on one surface thereof by using a gravure coater to have a thickness of 51 μm after the formation of intermediate layer, thereby forming an intermediate layer.

| Coating Solution 1 for Intermediate Layer | |
|---|---|
| Prefoamed hollow particle mainly comprising polyacrylonitrile (average particle diameter: 3.5 μm, hollow percentage by volume: 70%) | 60 parts |

-continued

| Coating Solution 1 for Intermediate Layer | |
|---|---|
| Water-dispersible acryl resin (AE337, trade name, produced by JSR Corp., minimum film-forming temperature: 0° C. or less) | 20 parts |
| Partially saponified polyvinyl alcohol (PVA205, trade name, produced by Kuraray Co., Ltd., saponification degree: 88%, polymerization degree: 500) | 20 parts |
| Water | 1,000 parts |

[Formation of Barrier Layer]

On the intermediate layer, Coating Solution 1 for Barrier Layer having the following composition was coated to have a coated amount in terms of solid content of 2 g/m$^2$ and dried to form a barrier layer. The moisture permeability after the formation of barrier layer was 341 g/m$^2$ day.

| Coating Solution 1 for Barrier Layer | |
|---|---|
| Ethylene vinyl alcohol copolymer (RS4103, trade name, produced by Kuraray Co., Ltd.) | 100 parts |
| Styrene-acryl copolymer resin (Polymalon 326, trade name, produced by Arakawa Chemical Industries, Ltd.) | 100 parts |
| Water | 1,000 parts |

[Formation of Receiving Layer]

On the barrier layer, Coating Solution 1 for Receiving Layer having the following composition was coated to have a coated amount in terms of solid content 5 of 5 g/m$^2$ and dried.

| Coating Solution 1 for Receiving Layer | |
|---|---|
| Polyester resin (Vylon 200, trade name, produced by Toyobo Co., Ltd.) | 100 parts |
| Silicone oil (KF393, trade name, produced by Shin-Etsu Chemical Co., Ltd.) | 3 parts |
| Polyisocyanate (Takenate D-140N, trade name, produced by Mitsui Takeda Chemicals Inc.) | 5 parts |
| A 1/1 (by mass) mixed solution of toluene/methyl ethyl ketone | 400 parts |

[Formation of Backside Layer]

On the sheet-like support surface where the receiving layer was not provided, Coating Solution 1 for Backside Layer having the following composition was coated to have a coated amount in terms of solid content of 3 g/m$^2$ and give a percentage of moisture content of 5% to the receiving layer, and dried to form a backside layer. The resulting sheet was aged at 50° C. for 48 hours to obtain a receiving sheet. The moisture permeability of the entire receiving sheet obtained was 314 g/m$^2$ day and shown in Table 1.

| Coating Solution 1 for Backside Layer | |
|---|---|
| Polyvinyl acetal resin (Eslec KX-1, produced by Sekisui Chemical Co., Ltd.) | 40 parts |
| Polyacrylic acid ester resin (Jurymer AT613, trade name, produced by Nihon Junyaku Co., Ltd.) | 20 parts |
| Nylon resin particle (MW330, trade name, produced by Shinto Paint Co., Ltd.) | 10 parts |

-continued

| Coating Solution 1 for Backside Layer | |
|---|---|
| Zinc stearate (Z-7-30, trade name, produced by Chukyo Yushi Co., Ltd.) | 10 parts |
| Cationic electrically conducting resin (Chemistat 9800, trade name, produced by Sanyo Chemical Industries Co., Ltd.) | 20 parts |
| A 2/3 (by mass) mixed solution of water/isopropyl alcohol | 400 parts |

Example 2

A receiving sheet was obtained in the same manner as in Example 1 except for using Coating Solution 2 for Intermediate Layer shown below in the formation of intermediate layer. The moisture permeability after the formation of barrier layer was 323 g/m$^2$ day.

| Coating Solution 2 for Intermediate Layer | |
|---|---|
| Prefoamed hollow particle mainly comprising polyacrylonitrile (average particle diameter: 3.5 μm, hollow percentage by volume: 70%) | 60 parts |
| Water-dispersible acryl resin (FK402S, trade name, produced by CSC Co., Ltd., minimum film-forming temperature: 0° C. or less) | 20 parts |
| Partially saponified polyvinyl alcohol (PVA205, trade name, produced by Kuraray Co., Ltd.) | 20 parts |
| Water | 1,000 parts |

Example 3

A receiving sheet was obtained in the same manner as in Example 1 except for using Coating Solution 2 for Barrier Layer shown below in the formation of barrier layer. The moisture permeability after the formation of barrier layer was 232 g/m$^2$ day.

| Coating Solution 2 for Barrier Layer | |
|---|---|
| Ethylene vinyl alcohol copolymer (RS4103, trade name, produced by Kuraray Co., Ltd.) | 100 parts |
| Styrene-acryl copolymer resin (Polymalon 326, trade name, produced by Arakawa Chemical Industries, Ltd.) | 100 parts |
| Swelling inorganic layers compound, sodium tetrasilicon mica (NTO-5, trade name, produced by Topy Industries, Ltd.) | 100 parts |
| Water | 1,000 parts |

Example 4

A receiving sheet was obtained in the same manner as in Example 1 except for using Coating Solution 3 for Barrier Layer shown below in the formation of barrier layer. The moisture permeability after the formation of barrier layer was 320 g/m$^2$·day.

| Coating Solution 3 for Barrier Layer | |
|---|---|
| Completely saponified vinyl alcohol (PVA110, trade name, produced by Kuraray Co., Ltd., saponification degree: 98.5%, polymerization degree: 1,000) | 100 parts |
| Styrene-acryl copolymer resin (Polymalon 326, trade name, produced by Arakawa Chemical Industries, Ltd.) | 100 parts |
| Water | 1,000 parts |

Example 5

A receiving sheet was obtained in the same manner as in Example 1 except for using Coating Solution 3 for Intermediate Layer shown below in the formation of intermediate layer. The moisture permeability after the formation of barrier layer was 315 g/m$^2$·day.

| Coating Solution 3 for Intermediate Layer | |
|---|---|
| Prefoamed hollow particle mainly comprising polyacrylonitrile (average particle diameter: 3.5 μm, hollow percentage by volume: 70%) | 60 parts |
| Water-dispersible acryl resin (AE337, trade name, produced by JSR Corp., minimum film-forming temperature: 0° C. or less) | 20 parts |
| Partially saponified polyvinyl alcohol (PVA505, trade name, produced by Kuraray Co., Ltd., saponification degree: 73%, polymerization degree: 500) | 20 parts |
| Water | 1,000 parts |

Example 6

A receiving sheet was obtained in the same manner as in Example 1 except for using Coating Solution 3 for Intermediate Layer (prepared in Example 5) in the formation of intermediate layer and using Coating Solution 2 for Barrier Layer (prepared in Example 3) in the formation of barrier layer. The moisture permeability after the formation of barrier layer was 220 g/m$^2$·day.

Comparative Example 1

A receiving sheet was obtained in the same manner as in Example 1 except for using Coating Solution 4 for Intermediate Layer shown below in the formation of intermediate layer. The moisture permeability after the formation of barrier layer was 450 g/m$^2$·day.

[Formation of Intermediate Layer]

| Coating Solution 4 for Intermediate Layer | |
|---|---|
| Prefoamed hollow particle mainly comprising polyacrylonitrile (average particle diameter: 3.5 μm, hollow percentage by volume: 70%) | 60 parts |
| Water-dispersible acryl resin (SX1706, trade name, produced by Zeon Corp., minimum film-forming temperature: >0° C.) | 20 parts |
| Partially saponified polyvinyl alcohol (PVA205, trade name, produced by Kuraray Co., Ltd.) | 20 parts |
| Water | 100 parts |

Comparative Example 2

A receiving sheet was obtained in the same manner as in Example 1 except for adjusting the drying in the formation of backside layer to give a percentage of moisture content of 10% to the receiving layer after coating and drying.

Comparative Example 3

A receiving sheet was obtained in the same manner as in Example 1 except for adjusting the drying in the formation of backside layer to give a percentage of moisture content of 1% to the receiving layer after aging treatment.

Evaluation

The receiving sheets obtained in Examples and Comparative Examples above each was measured by the following methods, and the results obtained are shown in Table 1.

[Measurement of Water Content]

As for the water content of the receiving sheet before and after aging treatment, the moisture content (%) was measured according to JIS P 8127. A specimen before drying was dried together with a vessel housing the specimen while putting a lid on the specimen vessel. Subsequently, the vessel housing the specimen was placed in a dryer adjusted to 105° C. and after removing the lid from the vessel, dried for 60 minutes or more. After the drying, the lid was put on inside the dryer, the vessel was transferred to a desiccator and cooled to room temperature, and the mass of the specimen was measured. The moisture content (%) is calculated according to the formula:

[(mass of specimen before drying−mass of specimen after drying)/(mass of specimen before drying)]×100.

[Measurement of Moisture Permeability]

The moisture permeability of the receiving sheet was measured according to JIS K 7129 by a moisture-sensitive sensor method using an automatic moisture permeability measuring device (L80-4000, trade name, manufactured by Risshi Co., Ltd.). The moisture permeability of the entire receiving sheet after aging is shown in Table 1.

[Image Uniformity]

Using a commercially available thermal transfer video printer (UP-DR100, trade name, manufactured by Sony Corp.), ink layers for three colors of an ink ribbon comprising a 6 μm-thick polyester film having provided thereon ink layers each containing a sublimable dye of yellow, magenta or cyan and a binder were sequentially contacted with the receiving sheet in an atmosphere of 23° C. and 50% RH and subjected to heating stepwise controlled by a thermal head to thermally transfer a predetermined image to the receiving sheet, whereby a color overlapped image was printed. Furthermore, the uniformity of the recorded image in the gradation portion corresponding to an optical density (black) of 0.3 was evaluated with an eye by observing whether irregular shading and white spot were present or not.

The evaluation results were indicated by "Good" when excellent, "Fair" when irregular shading or white spot was slightly observed, or "Bad" when irregular shading and white spot were serious. When the evaluation is "Good", the receiving sheet is sufficiently suited for practical use.

[Cold Peel Force for Ink Ribbon]

An ink ribbon comprising a 6 μm-thick polyester film having provided thereon an ink layer containing a yellow sublimable dye together with a binder was prepared, and the ink ribbon was transferred onto the receiving sheet by using a commercially available thermal transfer video printer (UP-DR100, trade name, manufactured by Sony Corp.). The transferred ink ribbon was trimmed to a width of 100 mm and by peeling off the ink ribbon in the horizontal direction at a speed of 30 mm/sec in an atmosphere of 23° C. and 50%, the peel force was measured with an electronic spring balance.

When the peel force in this measurement method is less than 100 gf, fusion-bonding may not occur in practical printing, but if it is 100 gf or more, fusion-bonding between the receiving sheet and the ink ribbon may be caused at printing or the like under high-temperature high-humidity conditions.

[Dynamic Hardness of Intermediate Layer]

The dynamic hardness of the intermediate layer of the receiving sheet was measured by using an ultramicro-hardness meter (DUH-201H, trade name, manufactured by Shimadzu Corporation). The indenter used was a 1150 triangular pyramid indenter, and the load was set so that the indentation depth from the receiving layer surface can go over the thickness of the receiving layer and reach the intermediate layer.

[Pore Diameter and Pore Volume of Intermediate Layer]

The pore distribution was measured by using a mercury press-fitting porosimeter (Poresizer 9320, trade name, manufactured by Shimadzu Corporation) with respect to two members, that is, a sheet-like support and an intermediate layer-formed product. The peak based on pores of the intermediate coating layer was specified by comparing the results of two members, and the pore diameter value and the pore volume value based on the intermediate coating layer were determined.

TABLE 1

| | Water Content of Receiving Sheet Before Aging Treatment (%) | Water Content of Receiving Sheet After Aging Treatment (%) | Moisture Permeability of Receiving Sheet, $g/m^2 \cdot day$ | Cold Peel Force, gf/100 m | Image Uniformity | Dynamic Hardness of Intermediate Layer | Pore Diameter of Intermediate Layer, μm | Pore Volume of Intermediate Layer, ml/g |
|---|---|---|---|---|---|---|---|---|
| Example 1 | 5.0 | 4.5 | 314 | 90 | Good | 0.50 | 0.28 | 0.13 |
| Example 2 | 5.0 | 4.5 | 290 | 72 | Good | 0.55 | 0.82 | 0.48 |
| Example 3 | 5.0 | 4.5 | 217 | 53 | Good | 0.51 | 0.28 | 0.13 |
| Example 4 | 5.0 | 4.5 | 305 | 80 | Good | 0.50 | 0.28 | 0.13 |
| Example 5 | 5.0 | 4.5 | 288 | 68 | Good | 0.48 | 0.31 | 0.15 |
| Example 6 | 5.0 | 4.5 | 205 | 50 | Good | 0.48 | 0.31 | 0.15 |
| Comparative Example 1 | 5.0 | 4.5 | 432 | 297 | Good | 3.30 | 0.05 | 0.06 |
| Comparative Example 2 | 10.0 | 9.5 | 314 | 150 | Good | 0.50 | 0.28 | 0.13 |
| Comparative Example 3 | 0.5 | 1.0 | 314 | 48 | Bad | 0.50 | 0.28 | 0.13 |

Example 7

Preparation of Intermediate Layer-Coated Sheet

70 Parts of a water dispersion (solid content concentration: 30%) of prefoamed hollow particle (main component: polyacrylonitrile, average particle diameter: 5.4 μm, void percentage by volume: 75%), 15 parts of a water solution (solid content concentration: 10%) of polyvinyl alcohol (PVA217, trade name, produced by Kuraray Co., Ltd.), and 15 parts of a styrene-butadiene copolymer latex (L-1537, trade name, produced by Asahi Kasei Corp., solid content concentration: 50%) were mixed and stirred to obtain a coating solution for intermediate layer. Subsequently, using an art paper (OK Kanefuji N, trade name, produced by Oji Paper Co., Ltd., basis weight: 186 g/m$^2$) as the support, the coating solution obtained above was coated on one surface thereof by a die coater to have a coated amount of 20 g/m$^2$ after drying and dried to prepare an intermediate layer-coated sheet.

(Preparation of Barrier Layer-Coated Sheet)

100 Parts of a water dispersion of sodium tetrasilicon mica as a swelling inorganic layered compound (average particle long diameter: 6.3 μm, aspect ratio: 2,700, a 5% water dispersion) was mixed with 100 parts of a water solution (solid content concentration: 10%) of polyvinyl alcohol (PVA105, trade name, produced by Kuraray Co., Ltd., polymerization degree: about 500) and 4 parts of a styrene-butadiene copolymer latex (L-1537, trade name, produced by Asahi Kasei Corp., solid content concentration: 50%), and the resulting mixture was stirred to obtain a coating solution for barrier layer. Subsequently, the coating solution for barrier layer was coated by a Mayer bar coater on the intermediate layer of the intermediate layer-coated sheet prepared above to have a coated amount of 3 g/m$^2$ after drying and dried to prepare a barrier layer-coated sheet.

(Preparation of Backside Layer-Coated Sheet)

70 Parts of an acrylic acid ester copolymer (AT731, trade name, produced by Showa Highpolymer Co., Ltd., Tg: 0° C., solid content concentration: 50%), 10 parts of an acryl resin filler (MA1013, trade name, produced by Nippon Shokubai Co., Ltd., average particle diameter: 13 μm), 10 parts of sodium polystyrenesulfonate (CS6120, trade name, produced by Sanyo Chemical Industries Co., Ltd.), and 10 parts of zinc stearate (Z-8-36, trade name, produced by Chukyo Yushi Co., Ltd., solid content concentration: 30%) were mixed and stirred to obtain a coating solution for backside layer. Subsequently, the coating solution for backside layer was coated by a Mayer bar coater on the back surface of the barrier layer-coated sheet prepared above to have a coated amount of 5 g/m$^2$ after drying and dried to prepare a backside layer-coated sheet.

(Preparation of Receiving Sheet)

100 Parts of a polyester resin (Vylon 200, trade name, produced by Toyobo Co., Ltd.), 2 parts of a silicone oil (KF393, trade name, produced by Shin-Etsu Chemical Co., Ltd.), and 6 parts of an isocyanate compound (Takenate D-110N, trade name, produced by Takeda Chemical Industries, Ltd.) were dissolved in 200 parts of a 1/1 (by mass) mixed solvent of toluene/methyl ethyl ketone, and the resulting solution was mixed and stirred to obtain a coating solution for receiving layer. Subsequently, the coating solution for receiving layer was coated by a gravure coater on the barrier layer of the backside layer-coated sheet prepared above to have a coated amount of 6 g/m$^2$ after drying and dried to obtain a receiving sheet.

Example 8

A receiving sheet was obtained in the same manner as in Example 7 except that in the preparation of the backside layer-coated sheet of Example 7, 70 parts of an acrylic acid ester copolymer (AT510, trade name, produced by Nihon Junyaku Co., Ltd., Tg: 28° C., solid content concentration: 30%) and 10 parts of silicone powder (KPM601, trade name, produced by Shin-Etsu Chemical Co., Ltd., average particle diameter: 12 μm) were used in place of 70 parts of an acrylic acid ester copolymer (AT731, trade name, produced by Showa Highpolymer Co., Ltd., Tg: 0° C., solid content concentration: 50%) and 10 parts of an acryl resin filler (MA1013, trade name, produced by Nippon Shokubai Co., Ltd., average particle diameter: 13 μm).

Example 9

A receiving sheet was obtained in the same manner as in Example 7 except that in the preparation of the backside layer-coated sheet of Example 7, 65 parts of an acrylic acid ester copolymer (SEK301, trade name, produced by Nihon Junyaku Co., Ltd., Tg: 18° C., solid content concentration: 40%) and 15 parts of a polyethylene emulsion (SN Coat 950, trade name, produced by San Nopco Ltd., average particle diameter: 10 μm) were used in place of 70 parts of an acrylic acid ester copolymer (AT731, trade name, produced by Showa Highpolymer Co., Ltd., Tg: 0° C., solid content concentration: 50%) and 10 parts of an acryl resin filler (MA1013, trade name, produced by Nippon Shokubai Co., Ltd., average particle diameter: 13 μm).

Evaluation

The quality evaluation of receiving sheets obtained in Examples and Comparative Examples above was performed on the following items. The evaluation results are shown in Table 2.

[Warpage and Printing/Traveling Performance of Receiving Sheet]

(i) High-Humidity Environment

The receiving sheet was cut into a standard postcard size (100 mm×148 mm) and left standing on a horizontal plane for 3 hours in an environment of 20° C. and 90% RH. Thereafter, the lift of four corners of the receiving sheet from the horizontal plane was measured, and an average value was calculated and used as curl data. Under the same environmental conditions, 10 receiving sheets were set in a sublimation thermal transfer video printer (NV-AP1, trade name, manufactured by Matsushita Electric Industrial Co., Ltd.), and the traveling performance of the receiving sheet was evaluated by printing a black solid image.

(ii) Low-Humidity Environment

The curl of the receiving sheet was measured in the same manner as above in an environment of 20° C. and 10% RH, and the traveling performance of the receiving sheet was also evaluated.

<Evaluation Criteria>

Excellent: The receiving sheet is only back-curled or top-curled to a height of 3 mm or less in high-humidity and low-humidity environments, scarcely warped and excellent in printing/traveling and paper-discharging performances.

Good: The receiving sheet is back-curled or top-curl to a height of more than 3 mm to 5 mm or less in high-humidity and low-humidity environments, sparsely warped and good in printing/traveling and paper-discharging performances.

Fair: The receiving sheet is back-curled or top-curl to a height of more than 5 mm to 10 mm or less in high-humidity and low-humidity environments and slightly warped, but the printing/traveling performance is not wrong, the paper discharging is smooth, and there is no problem in practical use.

Bad: The receiving sheet is back-curled or top-curl to a height of more than 10 mm in either a high-humidity environment or a low-humidity environment, a traveling failure due to warpage is generated at printing, and there is a problem in practical use.

[Back Printing Suitability]

10 Receiving sheets were set in a sublimation thermal transfer video printer (NV-AP1, trade name, manufactured by Matsushita Electric Industrial Co., Ltd.) by inverting front and back surfaces from the normal way and by printing a black solid image in an environment of 23° C. and 50% RH, the back printing suitability of the receiving sheet was evaluated according to the following criteria.

<Evaluation Criteria>

Good: Fusion-bonding between the backside coating layer and the ink ribbon is not generated at all and the paper discharging normally proceeds.

Fair: The backside coating layer and the ink ribbon are slightly fusion-bonded, but the paper discharging proceeds without trouble and this is in practical level.

Bad: The backside coating layer and the ink ribbon are fusion-bonded, troubles of jamming and ribbon breakage are generated in the printer, and there is a problem in practical use.

[Irregularity on Receiving Layer Surface]

The irregularity on the receiving layer surface of the receiving sheet obtained was evaluated with an eye according to the following criteria.

<Evaluation Criteria>

Good: Absolutely no irregularity and excellent appearance.

Fair: Irregularity is slightly present but has no problem in practical use.

Bad: Irregularity is significant and poor appearance.

TABLE 2

| | Water Content of Receiving Sheet after Aging Treatment (%) | Moisture Permeability of Receiving Sheet ($g/m^2 \cdot day$) | Backside Layer: Tg of Acryl Resin (° C.) | Backside Layer: Average Particle Diameter of Resin Filler (μm) | Backside Layer: Smoothness (sec) | Image Uniformity | Warpage and Traveling Performance of Receiving Sheet | Back Printing Suitability | Irregularity on Receiving Layer Surface |
|---|---|---|---|---|---|---|---|---|---|
| Example 7 | 5.5 | 360 | 0 | 13 | 7 | Good | Excellent | Good | Good |
| Example 8 | 5.5 | 370 | 28 | 12 | 32 | Good | Good | Fair | Good |
| Example 9 | 5.5 | 370 | 18 | 10 | 7 | Good | Good | Fair | Good |

It is confirmed from the results in Table 2 that the receiving sheets of Examples 7 to 9 are less warped even when the environment is changed, show good printing/traveling performance, have no problem in the back printing suitability and provide a good printed image.

INDUSTRIAL APPLICABILITY

The present invention overcomes a problem that in a receiving sheet using a paper sheet mainly comprising cellulose pulp as the support, the receiving sheet is readily fusion-bonded with an ink ribbon at printing, and provides a practically excellent thermal transfer image receiving sheet assured of high image uniformity. Furthermore, the present invention provides a thermal transfer receiving sheet which is less warped due to environmental fluctuation, free from occurrence of paper jamming, double feeding or the like in a printer and excellent in the printing/traveling performance and which ensures that at back printing, fusion-bonding does not arise between the backside coating layer and an ink ribbon and the traveling performance is good.

The invention claimed is:

1. A thermal transfer receiving sheet obtained by sequentially forming a hollow particle-containing intermediate layer and an image receiving layer on one surface of a sheet-like support mainly comprising cellulose pulp, a barrier layer being further formed between said intermediate layer and said image receiving layer and said barrier layer mainly comprises a swelling inorganic layered compound and an adhesive, wherein the moisture content of the entire thermal transfer receiving sheet is from 2 to 8 mass % and the moisture permeability of the entire receiving sheet is 400 $g/m^2 \cdot day$ or less.

2. The thermal transfer receiving sheet as claimed in claim 1, wherein said image receiving layer mainly comprises a dye-dyeable resin and a crosslinking agent having a water reactive functional group capable of crosslinking said resin.

3. The thermal transfer receiving sheet as claimed in claim 2, wherein said crosslinking agent having a water reactive functional group is a polyisocyanate compound.

4. The thermal transfer receiving sheet as claimed in claim 1, wherein said intermediate layer comprises a polyvinyl alcohol-based resin having a saponification degree of 65 to 90% and a polymerization degree of 200 to 1,000.

5. The thermal transfer receiving sheet as claimed in claim 1, wherein said intermediate layer comprises a water-soluble polymer and a water-dispersible resin and the minimum film-forming temperature of said water-dispersible resin is 0° C. or less.

6. The thermal transfer receiving sheet as claimed in claim 5, wherein said water-soluble polymer is a polyvinyl alcohol-based resin having a saponification degree of 65 to 90% and a polymerization degree of 200 to 1,000.

7. The thermal transfer receiving sheet as claimed in claim 1, wherein the dynamic hardness of said intermediate layer is 3.0 or less.

8. The thermal transfer receiving sheet as claimed in claim 1, wherein said intermediate layer has a peak in a pore diameter range of 0.01 to 10 μm according to the pore distribution measurement using a mercury press-fitting porosimeter.

9. The thermal transfer receiving sheet as claimed in claim 1, wherein the pore volume of said peak region is from 0.01 to 0.7 ml/g.

10. The thermal transfer receiving sheet as claimed in claim 1, wherein a backside layer is provided on the other surface of said support.

11. The thermal transfer receiving sheet as claimed in claim 10, wherein said backside layer mainly comprises an acryl-based resin having a glass transition point (Tg) of 45° C. or less and contains a resin filler having an average particle diameter of 5 to 22 μm and the Bekk smoothness according to JIS P 8119 on the backside layer surface is 100 seconds or less.

12. A method for producing a thermal transfer receiving sheet by sequentially forming a hollow particle-containing intermediate layer and an image receiving layer on one surface of a sheet-like support mainly comprising cellulose pulp, the method comprising, after the sequential formation of a hollow particle-containing intermediate layer and an image receiving layer on one surface of said sheet-like support, adjusting the moisture content of the entire thermal transfer receiving sheet to from 1 to 8 mass %, and then aging the thermal transfer receiving sheet, a barrier layer is further formed between said intermediate layer and said image receiving layer and said barrier layer mainly comprises a swelling inorganic layered compound and an adhesive, wherein the moisture permeability of the entire thermal transfer receiving sheet is 400 $g/m^2 \cdot day$ or less.

13. The method for producing a thermal transfer receiving sheet as claimed in claim 12, wherein said image receiving layer mainly comprises a dye-dyeable resin and a crosslinking agent having a water reactive functional group capable of crosslinking said resin.

14. The method for producing a thermal transfer receiving sheet as claimed in claim 13, wherein said crosslinking agent having a water reactive functional group is a polyisocyanate compound.

15. The method for producing a thermal transfer receiving sheet as claimed in claim 12, which further comprises, after sequentially forming a hollow particle-containing intermediate layer, an arbitrary barrier layer and an image receiving layer on one surface of said sheet-like support, a step of providing a backside layer on the other surface of said support.

16. The method for producing a thermal transfer receiving sheet as claimed in claim 15, wherein said backside layer mainly comprises an acryl-based resin having a glass transition point (Tg) of 45° C. or less and contains a resin filler having an average particle diameter of 5 to 22 μm and the Bekk smoothness according to JIS P 8119 on the backside layer surface is 100 seconds or less.

17. The method for producing a thermal transfer receiving sheet as claimed in claim 12, wherein the moisture permeability of the entire sheet-like support before said aging is adjusted to 400 $g/m^2 \cdot day$ or less.

* * * * *